United States Patent [19]

McGrew

[11] 4,089,082

[45] May 16, 1978

[54] MULTI-POSITION PAINT ROLLER FRAME

[76] Inventor: James D. McGrew, 7430 1/2 Girard, La Jolla, Calif. 92037

[21] Appl. No.: 812,167

[22] Filed: Jul. 1, 1977

Related U.S. Application Data

[63] Continuation-in-part of Ser. No. 660,158, Feb. 23, 1976, abandoned.

[51] Int. Cl.[2] ..... B05C 17/02; B25G 3/38

[52] U.S. Cl. ..... 15/230.11; 15/144 R

[58] Field of Search ..... 15/27, 144 R, 144 B, 15/146, 230.11, 248 A; 401/147, 197, 208, 218–220

[56] References Cited

U.S. PATENT DOCUMENTS

| | | | |
|---|---|---|---|
| 1,034,306 | 7/1912 | Ryker | 15/144 R UX |
| 1,732.508 | 10/1929 | Farris | 15/144 R X |
| 2,813,292 | 11/1957 | McLendon | 15/230.11 |
| 2,817,107 | 12/1957 | Zellinger | 15/230.11 X |
| 3,027,582 | 4/1962 | Pittman | 15/230.11 |

FOREIGN PATENT DOCUMENTS

| | | | |
|---|---|---|---|
| 1,010,286 | 11/1965 | United Kingdom | 15/144 R |

*Primary Examiner*—Daniel Blum
*Attorney, Agent, or Firm*—Ralph S. Branscomb

[57] ABSTRACT

The invention is an angularly adjustable paint roller assembly which attaches to the end of an extension pole and is characterized by an adjustable elbow brace which provides supplemental support to the adjusting pivot and establishes a position of maximum adjustment of on the order of 80° for the roller which defines an optimal angle for certain applications of the roller assembly and another position is struck by forwardly thrusting the pivot point of the elbow brace, establishing a roller angle of about 45° to the handle, so that in addition to being continually adjustable from 0° to 80° three distinct angles, including straight, may be quickly and accurately established.

4 Claims, 4 Drawing Figures

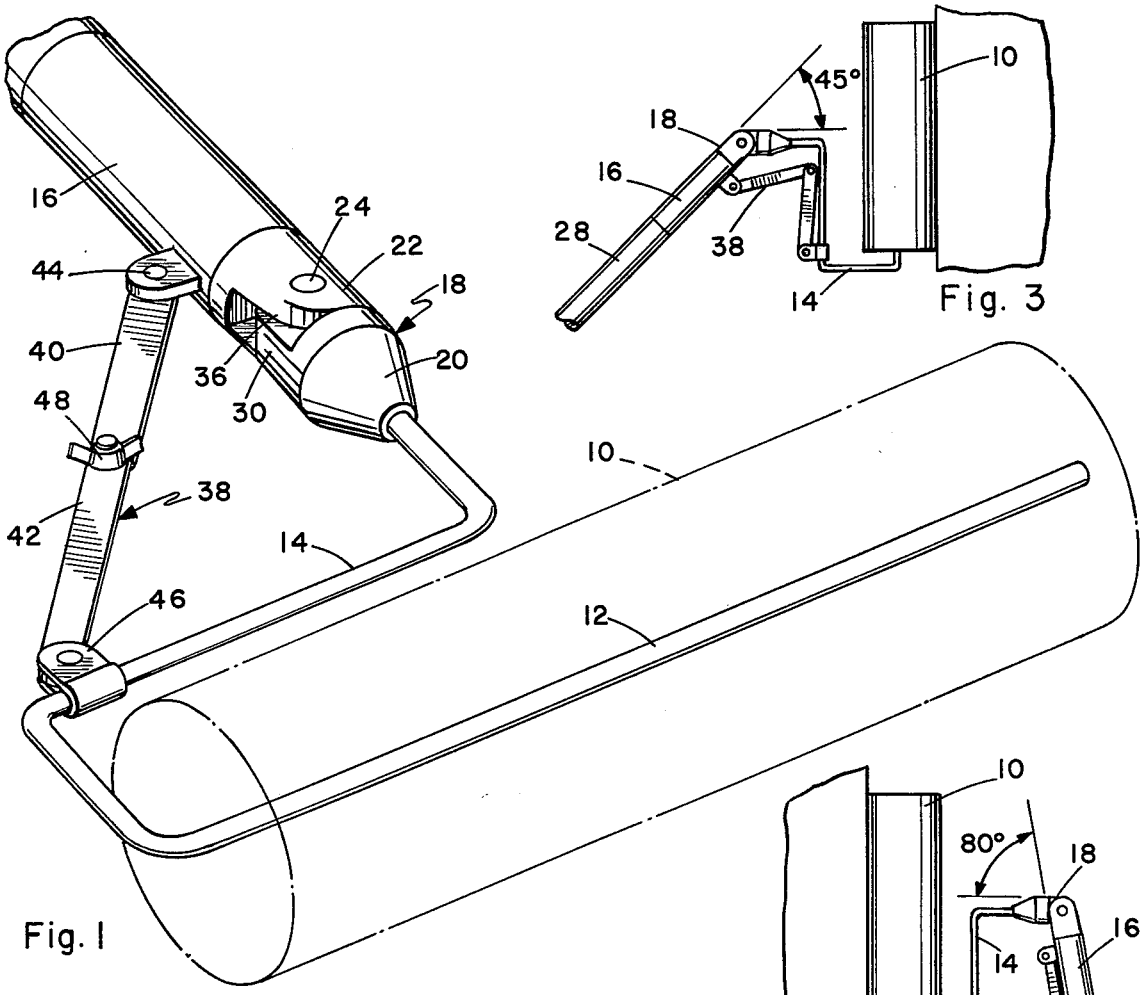
Fig. 1
Fig. 3
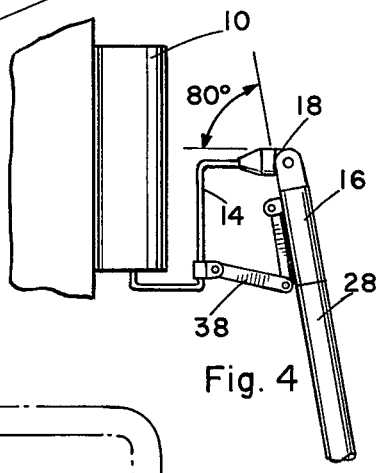
Fig. 4
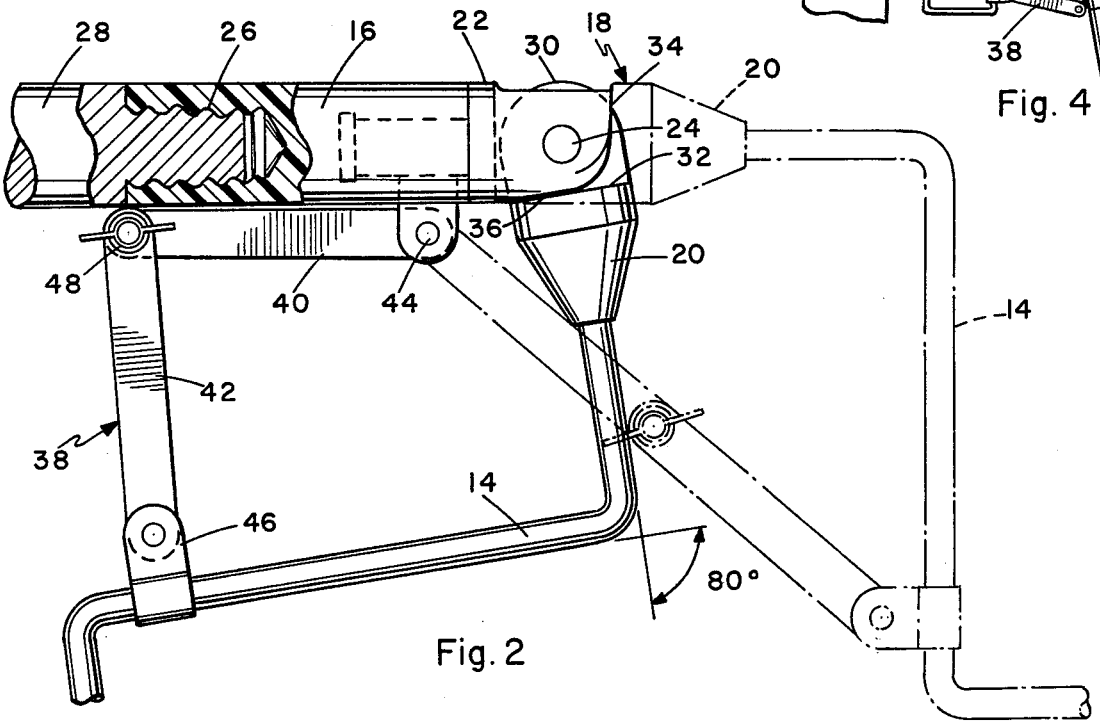
Fig. 2

MULTI-POSITION PAINT ROLLER FRAME

BACKGROUND OF THE INVENTION

This application is a continuation-in-part of application Ser. No. 660,158 filed Feb. 23, 1976 which is abandoned upon the filing of the herewith.

The invention if in the field of paint rollers which are angularly adjustable on their support mechanism which would ordinarily be mounted on an extension pole. Such a roller is particularly useful for painting wall surfaces just below ceiling level and in other applications in which an elevated, vertical surface needs to be painted with essentially horizontal strokes.

The need for such a paint roller is clear and is attested to by the fact that a number of such rollers have been developed. However, typically this prior art does not provide a firm hinge with supplemental support structure but rather a simple joint without supplemental support which would weaken and tend to slip or break with use. In addition, prior art adjustable rollers, insofar as they would operate at all, make no provision for simply and virtually automatically establishing one of several angles of adjustment which are optimum for various purposes.

SUMMARY OF THE INVENTION

The present invention comprises an adjustable paint roller having in addition to a knuckle joint which pivots the roller support bar on the connector shank, a supplemental elbow brace connecting the shank and the roller support bar to provide additional strength. In addition, this elbow brace is comprised of two pivotal legs one of which confronts or abuts against the shank of the assembly when the roller is in its position of maximum adjustment, thus limiting this position to an 80° adjustment from the normal orientation of the roller. The other leg of the elbow brace will abut the roller support assembly when the elbow joint is thrust forwardly so that a 45° angle is automatically established in this mode.

The knuckle joint which is the main support of the roller support bar comprises two pivotal members having contact surfaces which abut both in the conventional roller position and in the position of maximum adjustment so that in either of these configurations a very strong support is provided for the roller by the knuckle joint and elbow brace.

BRIEF DESCRIPTION OF THE DRAWINGS

FIG. 1 is a perspective view of the roller head assembly;

FIG. 2 is a top plan view of the assembly, partially cut away, showing the roller support in two positions;

FIG. 3 illustrates the roller in use with the head in the 45° offset position; and FIG. 4 illustrates the roller in use with the head in the 80° offset position.

DETAILED DESCRIPTION OF THE PREFERRED EMBODIMENT

The adjustable paint roller of the present invention includes the roller element 10 which is journalled on an axle rod 12 which is part of the roller support bar 14 typical of conventional paint rollers. The roller support bar is joined to a shank 16 by means of a knuckle joint 18 comprising two pivotal members 20 and 22 joined by a pin 24. The end of the shank is provided with a threaded bore 26 to receive the mating end of an extension pole 28 as shown in FIG. 2. Although obviously other connection means between the shank and the extension pole could be used, the invention assumes the use of some such extension inasmuch as the adjustable feature of the roller would otherwise have little utility.

As can best be seen in FIG. 1, the member 22 is bifurcated, at least in part, and the bifurcations straddle a tongue portion 30 of the member 20. The latter member also has a shoulder 32 on each side of the tongue and these shoulders define contact surfaces which confront the plane-defining surfaces 34 and 36 of the first pivotal member so that the outer limits of angular motion of these two members are defined by the contact surfaces. As illustrated in FIG. 2, when the roller is in its normal position the shoulders 32 confront the surfaces 34 to prevent adjustment beyond the normal position, and at the other extreme the shoulders confront the surfaces 36 limiting the angle through which the roller can be adjusted to about 80° , as indicated in FIG. 2.

Although the knuckle joint 18 is ideally fairly tight, the securing of the roller in its adjusted position is accomplished by means of a supplemental brace 38 which comprises a pair of arms 40 and 42 which are pivoted, respectively, to the shank at 44 and to the roller support bar at 46. These two arms are also pivotally connected together at a central pivotal point by means of a bolt and wing nut 48 which permits the adjustment of the roller to any position between those illustrated in FIG. 2 and securement in the selected position can be accomplished by tightening the wing nut.

Three positions of the roller are used much more than others and thus the support structure is designed to provide the maximum strength and rigidity in these three positions. The first position represents the conventional orientation between the roller and the shank as illustrated in FIG. 1, and as previously mentioned, the contact surfaces of the pivotal members comprising the knuckle joint 18 abut to form a rigid joint which is maintained under some compression by the linearly extended brace 38. The second position, illustrated in FIGS. 2 and 4, is important inapplications wherein it is desirable to apply horizontal roller strokes on a vertical surface, as illustrated in FIG. 4, such as immediately beneath the ceiling. In this mode, the first arm 40 of the brace is moved into confronting relation with the shank 16, as shown in FIG. 3, establishing automatically an angle of about 80°. This angle is somewhat less than 90° for the reason that it is desirable for the painter to space himself from the wall to permit the assumption of a more comfortable working stance and to avoid getting spattered. When the roller is oriented as shown in FIG. 2, with the arm 40 contiguous to the shank and the wingnut 48 tightened as well, in conjunction with the support provided by the contact surface 36 abutted against the shoulders 32, a very strong structure is obtained.

The third position, shown in FIG. 3, is characterized by the forward leg 42 of the elbow brace paralleling and contiguous the roller support bar 14 such that an angle of on the order of 45° is struck between the roller axis and the support handle as is indicated in FIG. 3. This position is strong by virtue of the direct bracing effect of the leg 38 against the bar 14, and useful also in making horizontal strokes above body level but below the level at which the FIG. 2 mode finds utility.

As previously mentioned, although the most rigid arrangements of the roller are at the 0°, 45° and 80° positions, the roller may be adjusted to any angle between 0° and 80° by a simple loosening of the wing nut. This simple structure, with a strong joint 18, is virtually incapable of becoming clogged with paint and will not loosen or weaken under continued use. The three positions established by the unique elbow brace structure are "digital" in that they are easily and quickly achieved without the need of fine adjustment as each position represents the farthest extension of the elbow brace in a particular direction.

The exact orientation of the roller in at least two of the basic positions clearly could be modified somewhat from 45° and 80°, and some variation could be incorporated in the elbow brace without loosing the bracing and digital locking functions.

I claim:

1. A multi-position paint roller frame comprising:

(a) a shank;

(b) a roller support bar pivotally mounted to said shank;

(c) said roller support bar establishing an axis for a paint roller and being pivotal such that said axis defines a variable angle with said shank;

(d) an elbow brace defined by two legs pivoted together at one end to define a central pivot point of said elbow brace;

(e) said shank, legs and roller support bar portion establishing the roller axis lying substantially in one plane and movable relative to each other in said plane;

(f) said elbow brace being pivotally mounted to and between said shank and said roller support bar and the legs being of a size such that the following three angular orientations of said axis relative to said shank are alternatively possible;

(i) a 0° deflection position wherein said axis and shank are perpendicular and said elbow brace is straight;

(ii) a position of maximum deflection of said roller axis wherein the central pivot point of said elbow brace is thrust rearwardly essentially against and supported by said shank;

(iii) a position intermediate the positions described in (i) and (ii) wherein said central pivot is forwardly thrust to rest substantially against and support said roller support bar; and (g) means to maintain the legs in a selected adjusted position.

2. Structure according to claim 1 wherein the angle defined between said shank and said axis is on the order of 10° in the position described in (ii) and on the order of 45° in the position described in (iii).

3. Structure according to claim 1 wherein said roller support bar is mounted on said shank by means of a knuckle joint which defines two positions of maximum pivoting of said roller support bar relative to said shank corresponding to the positions described in (i) and (ii) above so that dual reinforcement is provided to the roller support bar in said last mentioned positions.

4. Structure according to claim 1 wherein the central pivot point of said elbow brace is defined by a bolt and wing nut to permit infinite variation of the angular adjustment of said elbow brace.

* * * * *